US008122686B2

(12) United States Patent
Kollmuss

(10) Patent No.: US 8,122,686 B2
(45) Date of Patent: Feb. 28, 2012

(54) METHOD AND DEVICE FOR THE PRODUCTION OF PACKS

(75) Inventor: Manuel Kollmuss, Riedering (DE)

(73) Assignee: Krones AG, Neutraubling (DE)

( * ) Notice: Subject to any disclaimer, the term of this patent is extended or adjusted under 35 U.S.C. 154(b) by 402 days.

(21) Appl. No.: 12/584,550

(22) Filed: Sep. 8, 2009

(65) Prior Publication Data

US 2010/0064637 A1 Mar. 18, 2010

(30) Foreign Application Priority Data

Sep. 12, 2008 (DE) ..... 10 2008 044 519

(51) Int. Cl.
*B65B 11/00* (2006.01)

(52) U.S. Cl. ..... 53/411

(58) Field of Classification Search ..... 53/411, 53/131, 2, 4, 5; 493/187
See application file for complete search history.

(56) References Cited

U.S. PATENT DOCUMENTS

| | | | | |
|---|---|---|---|---|
| 3,293,824 A | | 12/1966 | Dorr | 53/131 |
| 3,662,511 A | | 5/1972 | Eliasberg | |
| 4,753,059 A | | 6/1988 | Natterer | 53/131 |
| 5,810,487 A | * | 9/1998 | Kano et al. | 400/83 |
| 6,508,173 B1 | | 1/2003 | Focke et al. | 101/485 |
| 7,313,894 B2 | * | 1/2008 | Mise et al. | 53/64 |
| 8,047,976 B2 | * | 11/2011 | Holbrook et al. | 493/13 |

FOREIGN PATENT DOCUMENTS

| | | |
|---|---|---|
| DE | 22 06 784 A | 8/1973 |
| DE | 35 20 499 A1 | 1/1987 |
| DE | 10 2006 009 348 A1 | 9/2007 |
| DE | 199 13 855 A1 | 9/2008 |
| GB | 2 142 282 A | 1/1985 |
| WO | WO 02/072354 A2 | 9/2002 |

* cited by examiner

*Primary Examiner* — Hemant M Desai
(74) *Attorney, Agent, or Firm* — Davidson, Davidson & Kappel, LLC.

(57) ABSTRACT

A method and a device for the production of a plurality of packs of articles wrapped with a respective portion of a plastic film are disclosed. A continuous film web is printed by a printing unit positioned at a position ($P_i$) along a transport path. Thereby, several respective printing areas spaced from each other are printed in a respective portion of a plastic film onto the continuous film web. Another position ($P_a$) for the printing unit along the transport path of the continuous film web is detected to a rate of feed ($v_T$) of the continuous film web in an area of the printing unit. At the detected other position ($P_a$), the rate of feed ($v_T$) of the continuous film web is adjusted on a printing rate of the printing unit and on the rate of feed ($v_T$) of the continuous film web in a wrapping film station subordinated to the printing unit. The printing unit is slid from the previous position ($P_i$) to the other detected position ($P_a$).

13 Claims, 3 Drawing Sheets

METHOD AND DEVICE FOR THE PRODUCTION OF PACKS

This claims the benefits of German Patent Application No. DE 10 2008 044 519.3 filed on Sep. 12, 2008, and hereby incorporated by reference herein.

The present invention relates to a method for the production of a plurality of packs of several articles being wrapped with a respective portion of a plastic film from a continuous film web. The present invention relates in particular to a method for the production of a plurality of packs of several articles being wrapped with a respective portion of a plastic film from a continuous film web, wherein a printing unit is provided at a position along a transport path and is designed to print onto the continuous film web. Thereby, a plurality of spaced apart printing areas in a respective portion of a plastic film is printed onto the continuous film web.

The present invention relates also to a device for the production of a plurality of the packs described above. The present invention relates in particular to a device for the production of a plurality of the packs described above, wherein the device includes a printing unit at a position along a transport path. Thereby, a plurality of spaced apart printing areas in a respective portion of a plastic film is printable with the printing unit onto the continuous film web.

BACKGROUND

Diverse methods and devices are known from the prior art, with which respective several articles are packed and wrapped respectively to a pack by wrapping with a plastic film and a portion of a plastic film respectively. The packs are liquid containers, for example, being wrapped with a portion of a plastic film, wherein said portion of a plastic film is attached to said pack by heat shrinking process. For example, six PET bottles or glass bottles or cans form a pack with the aid of the plastic film.

The packs for a single pack forming, also referred to as pack type in the following, are generally of the same design and the same size. When changing from one pack type to another pack type, also the design and the size of the packs changes, if necessary. The blanks of a plastic film and the portions of a plastic film respectively have also different dimensions according to the new pack type.

Firstly, the plastic film for the production of the packs is taken, for example, from one or several plastic film provision dispensers of a packing unit, rolls for example, in the form of a continuous film web. Then, the continuous film web is transported via a transport path on the basis of at least partially different rates of feed along further working stations of the packing unit. Finally, the continuous film web is transported to the articles ready to be wrapped and grouped and situated in a film wrapping station of the packing unit. Depending on the design of the packing unit shortly before, during or shortly after the wrapping of the articles with the continuous film web in order to form a pack at the film wrapping station.

Furthermore, it is customary for different pack types that the plastic film of the film wrapping station is supplied with different rates of feed and the grouped articles are wrapped and packed respectively also with different speed. As for packs of the same pack type it may happen, however, that the plastic film of the film wrapping station is also supplied with different rates of feed and the respective grouped articles intended for the packs of the same pack type are wrapped and packed respectively with different speeds. In both cases the rate of feed of the continuous film web has also to follow these changes of the rate of feed at the film wrapping station in areas before the film wrapping station, in order to provide sufficient portions of plastic film for the wrapping process. Per pack it is customary to apply at least one printed image onto the respective portion of a plastic film, which could be a sales message, a label, a brand and/or a bar code, for instance. These printed images are typically designed in the same way for all packs of a pack type and are positioned in the same place onto the respective portion of a plastic film. The printed images of the packs of a pack type differ, for example, in serial numbers or other data.

The printed images can already be applied onto the continuous film web so that different continuous film webs must be provided for different pack types. Alternatively, the printed images are printed onto the continuous film web at a later stage in the packing unit shortly before the articles are packed with a plastic film so that always only one "neutral" not printed continuous film web must be provided independent from the pack type. The printing onto the spread and even continuous film web kept in tension is carried out cleaner and easier than onto the portions of plastic films and/or onto the shrunk plastic film. The printed images are printed in spaced apart printing areas suitable to the size of the packs of the respective pack type onto the continuous film web so that exactly one printed image is positioned at the same position of the pack on the respective portion of a plastic film of the respective pack type which is separated later. In this way, too, a plurality of printed images per portion of a plastic film per pack is producible.

Thus, German patent application DE 10 2006 009 348 A1 discloses a method for the creation of packs consisting of a plurality of packaging units by wrapping said packaging units with a film material. Thereby, the film material is printed with at least one printing unit immediately before the wrapping process, wherein the printing unit is stationary located in direction of travel of the film material between the film supply and the film wrapping station. The feed motion of the continuous film web is controlled at least in the area of the print heads of the printing unit by means of an electronic control unit in order to obtain a definite printed image of high quality.

German patent application DE 22 06 784 A discloses an apparatus for the production of imprints onto single packages wherein said apparatus is positioned at a packing machine of articles. The apparatus has a print roller being stationary mounted on a shaft with at least one sector in which the printing or imprinting elements are stored. The print roller is driven in such a way that it carries out a fraction of a rotation according to a printing sector always in that moment when a printing operation should be carried out. The printing operation is carried out before the articles are packed.

German patent application DE 35 20 499 A1 discloses a packaging machine comprising a forming station for forming containers from a bottom foil, a supply means for supplying a cover foil from a supply rolling over said container, a sealing station for closing the containers with said cover foil, having a drive means for stepwise advancing said bottom and cover foil between the working cycles of said stations and printing means for printing on said cover foil during said working cycles of said stations. A drive means is provided for moving said cover foil through said printing means during said working cycles.

British patent application GB 2 142 282 A discloses an automatic packing machine for articles with a roll, from which a packing sheet is rolled off and transported further to a packing position. A printing unit prints the sheet underneath a receiving roll, wherein a printing tape is drawn out from a tape reel and wound on an empty reel disposed along said packing sheet. A heated type is pressed against the receiving roll through the packing sheet for printing the sheet. The printing process is likewise carried out before the articles are packed with the sheet.

Both, simple and/or small format images and complex and/or large-sized images should be printed onto the continuous film web.

SUMMARY OF THE INVENTION

It is an object of the invention is to provide a method for the production of a plurality of packs of articles which are wrapped with a at least partially printed plastic film, wherein the plastic film is printed reliably and independently of a rate of feed of the plastic film in a film wrapping station at the predetermined position.

The present invention provides a method for the production of a plurality of packs of several articles comprising the steps of:

wrapping packs with a respective portion of a plastic film from a continuous film web;

providing a printing unit at a position ($P_i$) along a transport path of the continuous film web, wherein the printing unit is designed to print on a plurality of spaced apart printing areas in a respective portion of the plastic film onto the continuous film web;

determining another position ($P_a$) for the printing unit along the transport path of the continuous film web with respect to a rate of feed ($v_T$) of the continuous film web, wherein at this another position ($P_a$) the rate of feed ($v_T$) of the continuous film web is adjusted to a printing rate of the printing unit and to the rate of feed ($v_T$) of the continuous film web in a film wrapping station being subordinated to the printing unit; and sliding the printing unit from the previous position ($P_i$) to the determined other position ($P_a$).

The present invention also provides a device for the production of a plurality of packs of articles which are wrapped with a plastic film so that the plastic film is reliably printable in a film wrapping station at the predetermined position independent of a rate of feed of the plastic film.

It is also an object of the present invention to provide a device for the production of a plurality of packs of several articles being wrapped with a respective portion of a plastic film from a continuous film web, wherein the device includes:

a printing unit at a position ($P_i$) along a transport path for printing several printing areas spaced from each other onto a respective portion of a plastic film onto the continuous film web, a film wrapping station for wrapping in each case several articles with a respective portion of a plastic film and said film wrapping station being subordinated to the printing unit another position ($P_a$) for the printing unit provided along the transport path of the continuous film web, wherein the other position ($P_a$) is determinable to a rate of feed ($v_T$) of the continuous film web in an area of the printing unit and at this other position ($P_a$) the rate of feed ($v_T$) of the continuous film web is adjusted to a printing rate of the printing unit and on the rate of feed ($v_T$) of the continuous film web (4) in the film wrapping station; and that the printing unit is designed slidable from the previous position ($P_i$) to the determined other position ($P_a$).

that the printing unit is designed slidable from the previous position ($P_i$) to the determined other position ($P_a$).

As for the method for the production of a plurality of packs of several articles being wrapped with a respective portion of a plastic film from a continuous film web according to the invention, a printing unit is provided and designed to print onto the continuous film web. Thereby, the printing unit is slidable provided according to the invention at a defined position along a transport path of the film web. During production of a single pack of a pack type, the printing unit rests, however, at the defined position. Suitable to a respective prevailing rate of feed of the plastic film in a film wrapping station being subordinated to the printing unit, a plurality of printing areas spaced from each other is printed from that very position in a respective portion of a plastic film onto the continuous film web. A pack still to be produced is intended per portion of a plastic film. The final determination of plastic film dimensions and the printing area depends amongst other things on the container form and the container size of the respective pack type and plastic film characteristics. In this stage, the portions of a plastic film are yet partial areas of the continuous film web and cut later by the continuous film web.

With the method according to the invention another position for the printing unit along the transport path of the continuous film web is determined when the rate of feed of the plastic film in the film wrapping station changes. This may occur, for instance, if the pack type changes.

This other position is determined suitable to the other rate of feed in the film wrapping station, also determined suitable for other differently printed portions of a plastic film of a predetermined pack type, for example, and suitable to a printing speed of the printing unit, so that the continuous film web can be printed at several, differently spaced apart printing areas if necessary, for the other pack type should the situation arise. The printing unit is slid according to the invention from the previous position to the new determined other position. Reasons for why and when it is recommendable to slide the printing unit are described in the following.

The invention utilizes that in devices for the production of packs the rate of feed of the plastic film usually is not constant but varies. The different rates of feed of the continuous film web are conditional upon the form of the pack yet to be produced of the articles wrapped with plastic film. Different rates of feed of the continuous film web also are independent of the respective pack type on hand, if the wrapping speed changes at the film wrapping station. This may occur, for example, because the processing speed and thus the averaged rate of feed of the plastic film are generally changed for the device for the production of packs. Furthermore, the rate of feed of the plastic film in the film wrapping station depends on the position of the wrapping element of the film wrapping station during the production of the packs. The maximum rate of feed during the transport of the plastic film over the grouped articles for the pack to be produced occurs usually during the wrapping process. The continuous film web, too, has to follow all of these speed changes in an area of the printing unit, in order to supply sufficient portions of plastic film for the wrapping process.

Furthermore, attention has to be paid to the fact that the printing unit is provided with a minimal and maximum transport area regarding the conveying speed, and lane speed, and rate of feed respectively of the continuous film web respectively. Thus it is possible in an embodiment of the printing unit to print clean and precise onto the continuous film web still with a rate of feed of up to 1.5 m/s, for instance, a speed which when exceeded a good print is no longer possible or the print is inaccurate. In order to change the rate of feed to the time of print then onto an optimal speed within the minimal and maximum speed limit, the printing unit is slid in its position according to the invention. As the position of the printed image on the portion of a plastic film and the rate of feed of the plastic film are only partially influencable or not influencable by the actual packing process, the only possibility to change the rate of feed while printing is to slide the entire printing unit either in or against the transport direction of the continuous film web.

The rates of feed of the continuous film web are generally known at respective different positions within the device for the production of the packs or can be determined on the basis of known means from the prior art.

It is hardly possible alone by regulating of the printing speed at the printing unit to comply optimally with the very different requirements on the printing complexity and printing quality for different pack types and for changing rates of feed in the film wrapping station respectively and hence the resulting rates of feed of the continuous film web in the sector of the printing unit. In contrast, the printing quality can be improved significantly by defined sliding of the printing unit to a position within the device by choosing a position with such a rate of feed of the plastic film that the desired printing areas onto the portions of a plastic film of the available pack type and the available rate of feed in the film wrapping station respectively can be printed optimally.

For different pack types, the dimensions of the portions of a plastic film can be different and/or the printing areas on the single portions of a plastic film can have a different size and/or be complex so that the printing speed should be adjusted to the printing requirements and the rate of feed of the respective pack type at hand. It may also happen that for different pack types the dimensions of the portions of a plastic film are the same although the printing areas on the single portions of a plastic film have, however, a different size and/or are complex and thus different rates of feed of the continuous plastic film occur in the area of the printing unit so that the position of the printing unit in the device is determined and adjusted according to the different printing requirements and different rates of feed of the plastic film. It is possible, for instance, to fully print the printing areas related for the portions of a plastic film onto the continuous film web or to print only one or several partitions of the printing area. The printing positions on the single printing areas to be printed are selectable in any order, too, for example centrical with reference to a single portion of a plastic film and/or at the edges of the portions of a plastic film. Independently thereof, the spacing of the printing areas to be printed is always the same for a single pack type.

The new other position for the printing unit along the transport path of the continuous film web for the changed rate of feed in the film wrapping station and/or the other portion of a plastic film of the available other pack type can be determined manually, for instance, by charts with data regarding pack types, printed images, complexity levels, possible printing speeds and possible rates of feed in the film wrapping station and the respective rates of feed at diverse available positions of the printing unit. The new other position can also be determined automatically from an electronic storage, a database or an electronic program, for instance, with the data mentioned above. Preferably the distance parameters defined by the differently spaced apart printing areas and/or different rates of feed in the film wrapping station are stored for respective different pack types and readout automatically.

The sliding of the printing unit from the previous position to the new determined other position can be carried out manually or automatically, motor-driven by at least one sliding rail onto which the printing unit is slid, for instance.

The device for the production of a plurality of packs of several articles being wrapped with a respective portion of a plastic film from a continuous film web according to the invention includes a printing unit at a position along a transport path as described above. Likewise, the position depends from a rate of feed in the film wrapping station and/or is determined by a pack type, as described above.

For sliding the printer unit from one position to another position, the device includes preferably a guide, one or two guide rails for instance. Marks can be applied at the guide marking the relative positions for the different pack types and/or the different rates of feed in the film wrapping station.

Preferably, the device includes a control unit for an automatic determination of the new other position for the printer unit. The control unit can be controlled electronically and/or by means of a software program. The parameters necessary for the determination of the position, such as pack type, dimensions and spaces apart from each other of the portions of the plastic film per pack type respectively, printed images per pack type, rate of feed in the film wrapping station and per possible position in the device, parameter of the printer unit such as speed parameter of the printer unit, can be stored in a database or data chart, for instance. Preferably, the readout and the processing of the parameters for the determination of the new other position are carried out automatically.

BRIEF DESCRIPTION OF THE DRAWINGS

Embodiments of the present invention will now be explained in greater detail on the basis of the accompanying figures. The proportions of the individual elements to each other in the figures do not always correspond with the real proportions since for the sake of a better demonstration some forms are shown simplified whereas other forms are shown enlarged in relation to other elements.

DETAILED DESCRIPTION

Same reference numbers refer to same elements throughout the various figures, and are not explained repeatedly. For the sake of clarity, only reference numbers necessary for the description of the respective figure are furthermore shown in the individual figures. The shown embodiments are only examples of how the device or the method according to the invention can be designed and are not to be regarded as a limitation of the invention.

Figure 1:
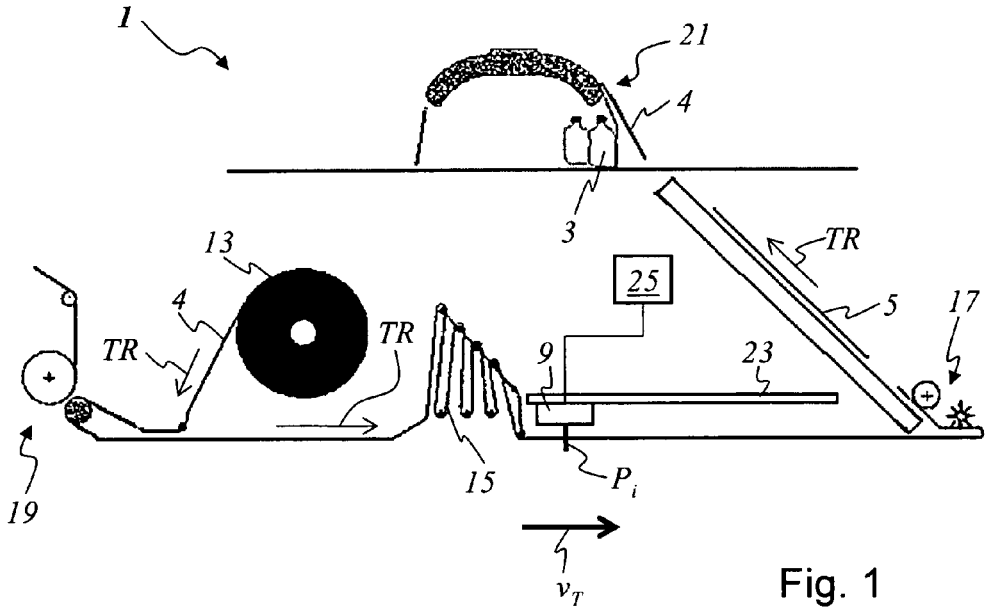
FIG. 1 shows a lateral view of an embodiment of the device according to the invention with a printer unit being positioned at a position $P_i$.

FIG. 1 shows a lateral view of an embodiment of the device 1 according to the invention having a printer unit 9 being positioned at a position $P_i$. The device 1 includes a plastic film storage 13, from which a continuous film web 4 is rolled off and transported to the device 1. A labeling station 19 optionally provides the continuous film web 4 with labels and/or grab handles. The continuous film web 4 is transported further to a plastic film control unit 15 in transport direction TR, which controls the web tension of the continuous film web 4 and buffers the continuous film web 4 respectively. Behind the plastic film control unit 15, regarded from the trans-port direction TR, the rate of feed $v_T$ is dependant of the position of the portion of a plastic film 5 within the film wrapping station 21. If one assumes that the rate of feed $v_T$ for a particular pack type suits best for the print at position $P_i$, so it is possible to print there complex printed images and the printed images at predetermined printing areas 11 respectively the most optimal.

The printer unit 9 is connected with a control unit 25 for automatic determination of a new other position $P_a$ for a pack type following the actual pack type. The control unit 25 is connected with the printer unit 9 in the shown embodiment of the invention.

The printer unit 9 is slidable positioned at a guide 23 in order to be slid from position $P_i$ to another position $P_a$, if another rate of feed $v_T$ is set in the film wrapping station 21. This may occur, for example, if another pack type is provided wherein an optimal rate of feed $v_T$ for the print is adjusted at another position of the continuous film web 4 in the transport path 7.

After printing, the continuous film web 4 is transported to a plastic film separating station 17, where the portions of a plastic film 5 are perforated and/or cut. Then the single portions of a plastic film 5 are transported to a film wrapping station 21 in transport direction TR, where groups of articles 3 are wrapped and packed respectively with a portion of a plastic film 5 per group according to a prevailing rate of feed $v_T$ of the plastic film 4 and 5 respectively.

Figure 2:
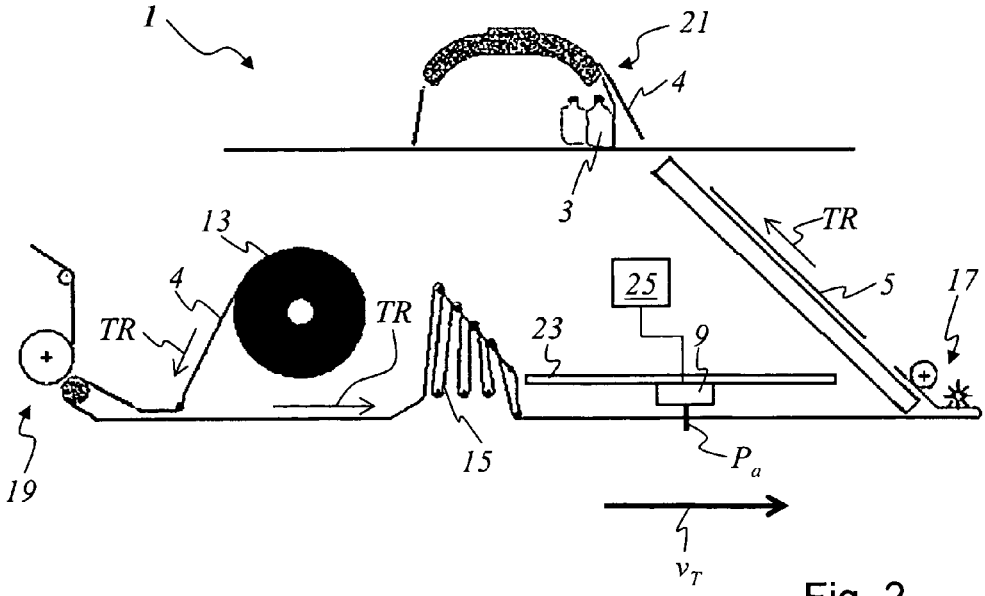
FIG. 2 shows a lateral view of the embodiment of the device according to the invention subject to FIG. 1, wherein the printer unit is positioned at a new other position $P_a$.

FIG. 2 shows a lateral view of the embodiment of the device 1 according to the invention subject to FIG. 1, wherein the printer unit 9 has been slid from position $P_i$ according to FIG. 1 to a new position $P_a$, in order to print now other printing areas 11 (see FIG. 4) on the continuous film web 4 for another pack type, according to which the rate of feed $v_T$ changes in the film wrapping station 21.

The rate of feed $v_T$ at position $P_a$ of the printer unit 9 is chosen in such a way that it is possible to carry out the printed image completely and faultless in the printing area 11 intended for this purpose.

Figure 3:
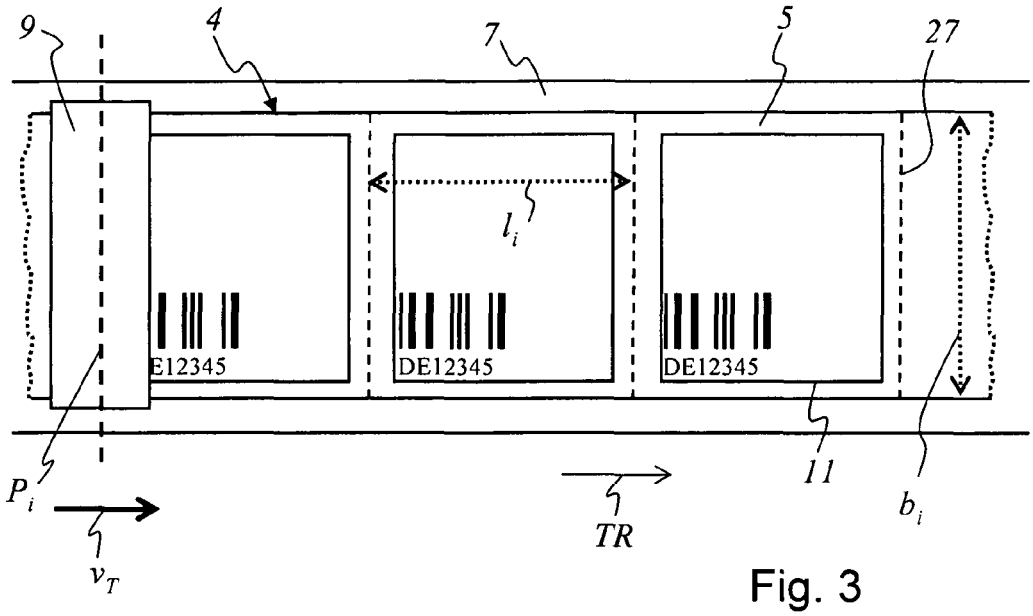
FIG. 3 shows a top view onto a section of the continuous film web with printed printing areas, wherein the printer unit of the device according to FIG. 1 is positioned at position $P_i$.

FIG. 3 shows a top view onto a section of the continuous film web 4 with printed and not yet printed printing areas 11 respectively, wherein the printer unit 9 of the device 1 according to FIG. 1 is positioned at position $P_i$ and prints according to the rate of feed $v_T$ of the continuous film web 4 prevailing there. The printing areas 11 of two portions of a plastic film 5 have already been printed, the printing area 11 of a third portion of a plastic film 5 is being printed at the moment. A respective bar code with text is printed into the printing areas 11 shown in this embodiment here.

The printing areas 11 are spaced apart from each other and do not fill the entire area of the respective portion of a plastic film 5 at a time, since the edges of the portions of a plastic film 5 should not be taken into account for print because of the shrinking process and/or the wrinkling at the film wrapping station 21 (see FIGS. 1 and 2), as the printed image will not be sufficiently readable in these areas. The portions of a plastic film 5 are positioned in contrast on the continuous film web 4 completely and separated from each other by cutting lines 27. The cutting lines 27 indicate later cuts of the portions of a plastic film 5 onto the continuous film web 4. In this stage, however, the portions of a plastic film 5 on the continuous film web 4 are yet not spatially separated from said continuous film web 4.

The continuous film web 4 is transported on a transport path 7 in transport direction TR. The length of the portions of a plastic film 5 in transport direction TR is in each case $l_i$. In this embodiment, the print head of the printer unit 9 extends over the entire width $b_i$ of the continuous film web 4.

Figure 4:
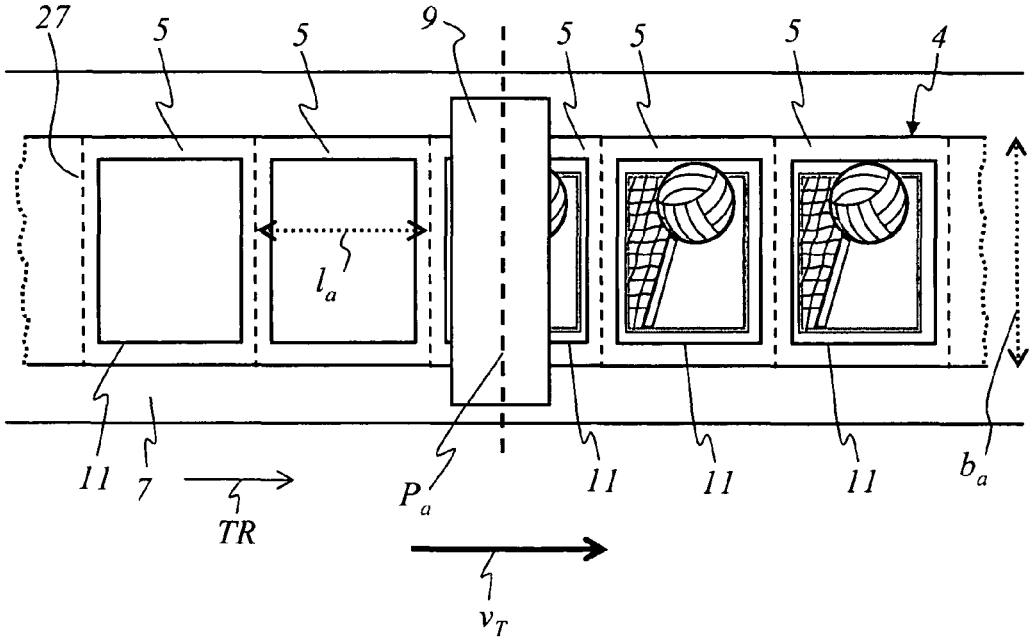
FIG. 4 shows a top view onto a section of the continuous film web with printed printing areas, wherein the printer unit of the device according to FIG. 1 is positioned at the new other position $P_a$.

FIG. 4 shows a top view onto a section of the continuous film web 4 with printed printing areas 11, wherein the printer unit 9 of the device 1 according to FIG. 1 is positioned at the new other position $P_a$, in order to print there the continuous film web 4 for another pack type. The new other position $P_a$ is thereby chosen in such a way that the rate of feed $v_T$ prevailing at position $P_a$ is optimal for a faultless print.

The printing areas 11 of two portions of a plastic film 5 are already printed, the printing area 11 of a third portion of a plastic film 5 is being printed at the moment and two further portions of a plastic film 5 are yet to be printed. In each case a graphic is printed into the printing areas 11 in this shown embodiment, which almost fills out the entire area of the respective printing area 11 in each case.

The continuous film web 4 is transported in transport direction TR on the transport path 7 according to FIG. 3. The length $l_a$ of the portions of a plastic film 5 in transport direction TR is shorter than the length $l_i$ of the portions of a plastic film 5 for the pack type according to FIGS. 1 and 3. The position P, at which the print head of the printer unit 9 is to be positioned, should be chosen in such a way that with the actual prevailing rate of feed $v_T$ of the continuous film web 4, the print head can print the printing areas 11 faultless with its prevailing printing speed. In this embodiment, the print head of the printer unit 9 extends over the entire width $b_a$ of the continuous film web 4.

Figure 5:
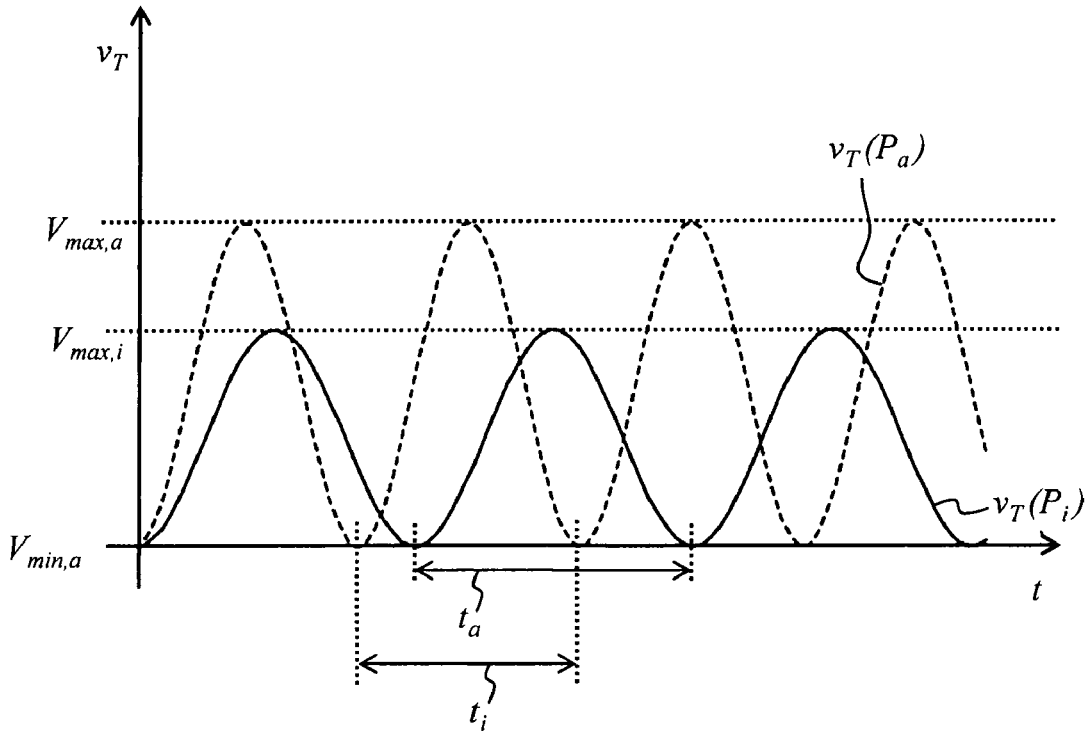
FIG. 5 shows a chart displaying the course of the rate of feed of the time for the two different pack types according to FIGS. 1 and 3 on the one hand, and according to FIGS. 2 and 4 on the other hand.

FIG. 5 shows a chart, displaying the course of the rate of feed $v_T$ of the time t for the two different pack types according to FIGS. 1 and 3 on the one hand, and according to FIGS. 2 and 4 on the other hand.

With each a single portion of a plastic film 5, a single group of articles is wrapped to the respective pack to be produced. According to FIGS. 3 and 4, the print head of the printer unit 9 extends in this embodiment over the entire width $b_i$ and $b_a$ of the continuous film web 4 respectively for the two pack types. As already mentioned, the rate of feed $v_T$ of the portion of a plastic film 5 is not constant during the wrapping process. The rate of feed $v_T$ is changeable during the supply of the continuous film web 4 through the device 1 in order to sustain a constant supply of the continuous film web 4 for the wrapping process. At a certain point, the rate of feed $v_T$ reaches in this shown embodiment a maximum $v_{Max}$, which is different with $v_{Max,i}$ and $v_{Max,a}$ respectively for the pack type according to FIGS. 1 and 3 and the pack type according to FIGS. 2 and 4 respectively, depending from the format of the pack types of the respective pack type and dependant from a generally prevailing processing speed in the device 1 respectively defining the rate of feed $v_T$ in the film wrapping station 21, as mentioned above.

A next portion of a plastic film 5 follows the single portion of a plastic film 5 without gaps according to space and time as also described above. Thus the single portion of a plastic film 5 to be printed also moves along all possible positions P for the printer unit 9 in the device 1. Thus, the single portion of a plastic film 5 moves on the other hand with all rates of feed $v_T$ prevailing at the possible positions P, wherein the single portion of a plastic film 5 should be printed only at the actual chosen and adjusted position P, at which the rate of feed $v_T$ is the most optimal for the print to be carried out.

For different rates of feed $v_T$ in the film wrapping station 21, in particular for different pack types, both the time period $t_i$ and $t_a$ respectively for the printing of a single portion of a plastic film 5, and the maximum rate of feed $v_{max,i}$ and $v_{max,a}$ respectively can therefore be different, as for the shown pack types here, so that the curves of the chart according to FIG. 5 display different amplitudes and rates per pack type with position $P_i$ and position $P_a$ of the printer unit 9 respectively.

The invention was described with reference to a preferred embodiment. It is obvious for a skilled person, however, that modifications or changes of the invention can be carried out without departing from the scope of the following claims. Due to different rates of feed $v_T$ in the film wrapping station 21, the previous position $P_i$ and the new determined position $P_a$ can be the same, in particular with consecutive pack types, since printing speed and plastic film speed are adjusted on each other in a suitable way. A crucial factor for all embodiments of the invention is particularly the repositioning of the printer unit depending from the necessary rate of feed $v_T$ of the continuous film web 4 in each case, in order to obtain a faultless printed image on the respective printing area 11 and finally also a faultless reproduction of the printed image on the wrapped pack of the respective pack type.

What is claimed is:

1. A method for the production of a plurality of packs of several articles comprising the steps of:

wrapping packs with a respective portion of a plastic film from a continuous film web;

providing a printing unit at a position ($P_i$) along a transport path of the continuous film web, wherein the printing unit is designed to print on a plurality of spaced apart printing areas in a respective portion of the plastic film onto the continuous film web;

determining another position ($P_a$) for the printing unit along the transport path of the continuous film web with respect to a rate of feed ($v_T$) of the continuous film web, wherein at this another position ($P_a$) the rate of feed ($v_T$) of the continuous film web is adjusted to a printing rate of the printing unit and to the rate of feed ($v_T$) of the continuous film web in a film wrapping station being subordinated to the printing unit; and sliding the printing unit from the previous position ($P_i$) to the determined other position ($P_a$).

2. The method of claim 1, wherein after sliding the printing unit from the previous position ($P_i$) to the detected other position ($P_a$), continuous film web is printed with the printing unit on the plurality of printing areas of the continuous film web.

3. The method of claim 1, wherein the determination of the other position ($P_a$) for the printing unit is carried out depending on a predetermined pack type.

4. The method of claim 3, wherein the determination of the other position ($P_a$) for the printing unit is carried out depending on distance parameters and picture parameters of the printing areas of the respective predetermined pack type.

5. The method of claim 4, wherein the distance parameters and picture parameters defined by the printing areas spaced from each other are stored for the different pack types and readout automatically.

6. The method of claim 1, wherein the other position ($P_a$) for the printing unit is automatically determined along the transport path of the continuous film web, wherein the other position ($P_a$) is calculated from the respective rate of feed ($v_T$) of the continuous film web at positions (P) of the printing unit which are available and from printing rate parameters predetermined by the printing unit.

7. The method of claim 6, wherein distance parameters and picture parameters defined by the printing areas spaced from each other are stored for the different pack types and readout automatically.

8. The method of claim 1, wherein the sliding of the printing unit from the previous position ($P_i$) to the determined other position ($P_a$) is carried out automatically.

9. A device for the production of a plurality of packs of several articles being wrapped with a respective portion of a plastic film from a continuous film web, wherein the device comprises:

a printing unit at a position ($P_i$) along a transport path for printing several printing areas spaced from each other onto a respective portion of a plastic film onto the continuous film web, a film wrapping station for wrapping in each case several articles with a respective portion of a plastic film and said film wrapping station being subordinated to the printing unit another position ($P_a$) for the printing unit provided along the transport path of the continuous film web, wherein the other position ($P_a$) is determinable to a rate of feed ($v_T$) of the continuous film web in an area of the printing unit and at this other position ($P_a$) the rate of feed ($v_T$) of the continuous film web is adjusted to a printing rate of the printing unit and on the rate of feed ($v_T$) of the continuous film web (4) in the film wrapping station; and that the printing unit is designed slidable from the previous position ($P_i$) to the determined other position ($P_a$).

10. Device of claim 9, wherein a guide is provided by which the printing unit is slidable from the position ($P_i$) to the determined other position ($P_a$).

11. Device of claim 10, wherein the guide is in the form of guide rails.

12. Device of claim 10, wherein markings are provided at the guide, which mark the respective positions (P) for the different pack types and/or different rates of feed ($v_T$) in the film wrapping station.

13. The device of claim 9, further comprising a control unit for automatic determination of the other position ($P_a$).

* * * * *